US007721895B2

(12) United States Patent
Mueller et al.

(10) Patent No.: US 7,721,895 B2
(45) Date of Patent: May 25, 2010

(54) SCREENING DEVICE FOR WET SCREENING OF PAPER FIBER SUSPENSIONS

(75) Inventors: Wolfgang Mueller, Weingarten (DE); Roland Reinhold, Ravensburg (DE); Gert Gottschalk, Ravensburg (DE)

(73) Assignee: Voith Paper Patent GmbH, Heidenheim (DE)

( * ) Notice: Subject to any disclaimer, the term of this patent is extended or adjusted under 35 U.S.C. 154(b) by 721 days.

(21) Appl. No.: 11/536,930

(22) Filed: Sep. 29, 2006

(65) Prior Publication Data

US 2007/0084761 A1 Apr. 19, 2007

(30) Foreign Application Priority Data

Oct. 19, 2005 (DE) ..... 10 2005 049 943

(51) Int. Cl.
*B07B 1/20* (2006.01)
*B07B 1/49* (2006.01)

(52) U.S. Cl. ..... 209/306; 209/305; 209/405; 209/410

(58) Field of Classification Search ..... 209/283, 209/305, 306, 397, 399, 403, 254, 412, 413, 209/352, 358, 359, 389, 408, 659, 680, 281, 209/274, 276, 404, 405, 410, 411; 210/499, 210/483, 495; 162/55
See application file for complete search history.

(56) References Cited

U.S. PATENT DOCUMENTS 3,477,572 A * 11/1969 Mckibben ..... 209/255
4,904,378 A * 2/1990 Arai ..... 209/400
5,509,536 A * 4/1996 Mannes ..... 209/273
6,705,554 B1 * 3/2004 Kolle ..... 241/46.11
7,497,338 B2 * 3/2009 Garrett et al. ..... 209/381
2005/0072730 A1 * 4/2005 Aikawa ..... 210/483
2005/0274655 A1 * 12/2005 Barrett et al. ..... 209/392

FOREIGN PATENT DOCUMENTS

DE 19506084 8/1996

OTHER PUBLICATIONS

English Language Abstract of DE 195 06 084.
English Language Abstract of DE 195 06 084, Aug. 29, 1996.

* cited by examiner

*Primary Examiner*—Patrick H Mackey
*Assistant Examiner*—Mark Hageman
(74) *Attorney, Agent, or Firm*—Greenblum & Bernstein, P.L.C.

(57) ABSTRACT

A screening device for the wet screening of a paper fiber suspension comprising at least one screen plate having a plurality of screen openings, a support structure being detachably attachable to the screen plate, a rotor movable adjacent the screen plate and an outlet opening for a portion of the paper fiber suspension passing the screen openings The support structure of the device is characterized by an outer support ring and an inner support ring and at least one middle support element arranged radially between the inner and outer support rings to support the at least one screen plate. Elastic pre-stressing against the screen plate is generated, and as a result of the elastic pre-stressing, the screen plate exerts compressive forces on at least one radially intermediate support element and respectively exerts tensile forces both on the inner support ring and on the outer support ring.

25 Claims, 3 Drawing Sheets

SCREENING DEVICE FOR WET SCREENING OF PAPER FIBER SUSPENSIONS

CROSS-REFERENCE TO RELATED APPLICATIONS

The present application claims priority under 35 U.S.C. §119 of German Patent Application No. 10 2005 049 943.0, filed on Oct. 19, 2005, the disclosure of which is expressly incorporated by reference herein in its entirety.

BACKGROUND OF THE INVENTION

1. Field of the Invention

The invention relates to a screening device for the wet screening of paper fiber suspensions. The device includes at least one screen plate provided with a plurality of screen openings, a support structure to which the screen plate is to be attached in a detachable manner with its back and a rotor that can be moved closely along the screen plate. An outlet opening is provided for the part of the paper fiber suspension passing through the screen openings.

2. Discussion of Background Information

Screening devices are used in paper stock preparation, e.g., in sorters and pulpers of the pulp and paper industry, in order to treat the fiber suspension during a wet screening. In most cases, non-fibrous impurities and not yet disintegrated paper are thereby to be retained at a screen as a result of their size and then to be discharged. The passing of fiber suspension through the screen openings involves a considerable loss of pressure. This leads to strong forces pressing against the screen, which are absorbed as compressive forces by the support structure. The screens of such devices are usually made of metal, e.g., alloyed high-grade steel.

In order to prevent a clogging of the screen openings, typically scrapers attached to a rotor are used, which move closely along the openings, thereby creating hydraulic pressure impulses and hydraulic suction impulses. These impulses can cause the screen plate to vibrate, which stresses both the support structure and the screen plate. Other hydraulic impulses (thrusts) that can endanger said components originate in the periphery of a screening device, e.g., actuated sliders and pumps in the connecting lines. Even welded components are endangered by the vibrations.

The mentioned stress conditions during wet screening necessitate a complex and sturdy attachment of the screen plates, which implements in most cases a reduction of free screen area.

It is known that the effect of the scrapers can be improved by protruding strips, as these cause turbulences that prevent solid materials from depositing. Mounted strips of this type are disclosed, e.g., in DE 195 06 084A1.

SUMMARY OF THE INVENTION

This invention is directed to screening devices for the wet screening of paper fiber suspensions, characterized by a simple structure that can well tolerate vibrations and hydraulic impulses occurring during wet screening. The screen plates of the device can be attached in a reliable and easy manner. Losses in free screen area through the means of attachment are kept to a minimum.

The screening device comprises a screen plate, which is attached in a detachable manner, preferably screwed together, to an outer support ring and an inner support ring and the screen plate lies against at least one support element arranged radially between inner support ring and outer support ring.

Elastic pre-stressing against the screen plate is generated, and as a result of the elastic pre-stressing, the screen plate exerts compressive forces on at least one radially intermediate support element and respectively exerts tensile forces both on the inner support ring and on the outer support ring.

The screening device of the invention is characterized by a specific support structure, which comprises an outer support ring and an inner support ring and at least one middle support element arranged radially between the inner and outer support ring. In the mounted state of the screen plate, elastic pre-stressing is generated against the screen plate, causing compressive forces directed against the middle support element and tensile forces against the inner and outer support rings, whereby said generated forces exceed the tensile forces produced by vibrations and thrusts occurring against the screen plate during wet screening.

The measures make it possible to attach the screen plate—irrespective of whether it is produced from one piece or assembled from various segments—with simple elements on a simplified support structure such that a durable connection is ensured even with vibrations occurring inevitably. According to the invention a screen plate pre-stressed in the manner described is insusceptible to the vibrations and hydraulic thrusts inevitably occurring with screening devices of this type. The measures described make it possible to simplify the support structure, in particular by reducing the surface area needed for the screen plate to rest on. This not only simplifies the structure and mounting, but also has the effect that less screen area of the screen plate is blocked by the support structure. The smaller number of the screw joints hitherto required means also a considerable simplification and reduction in cost.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
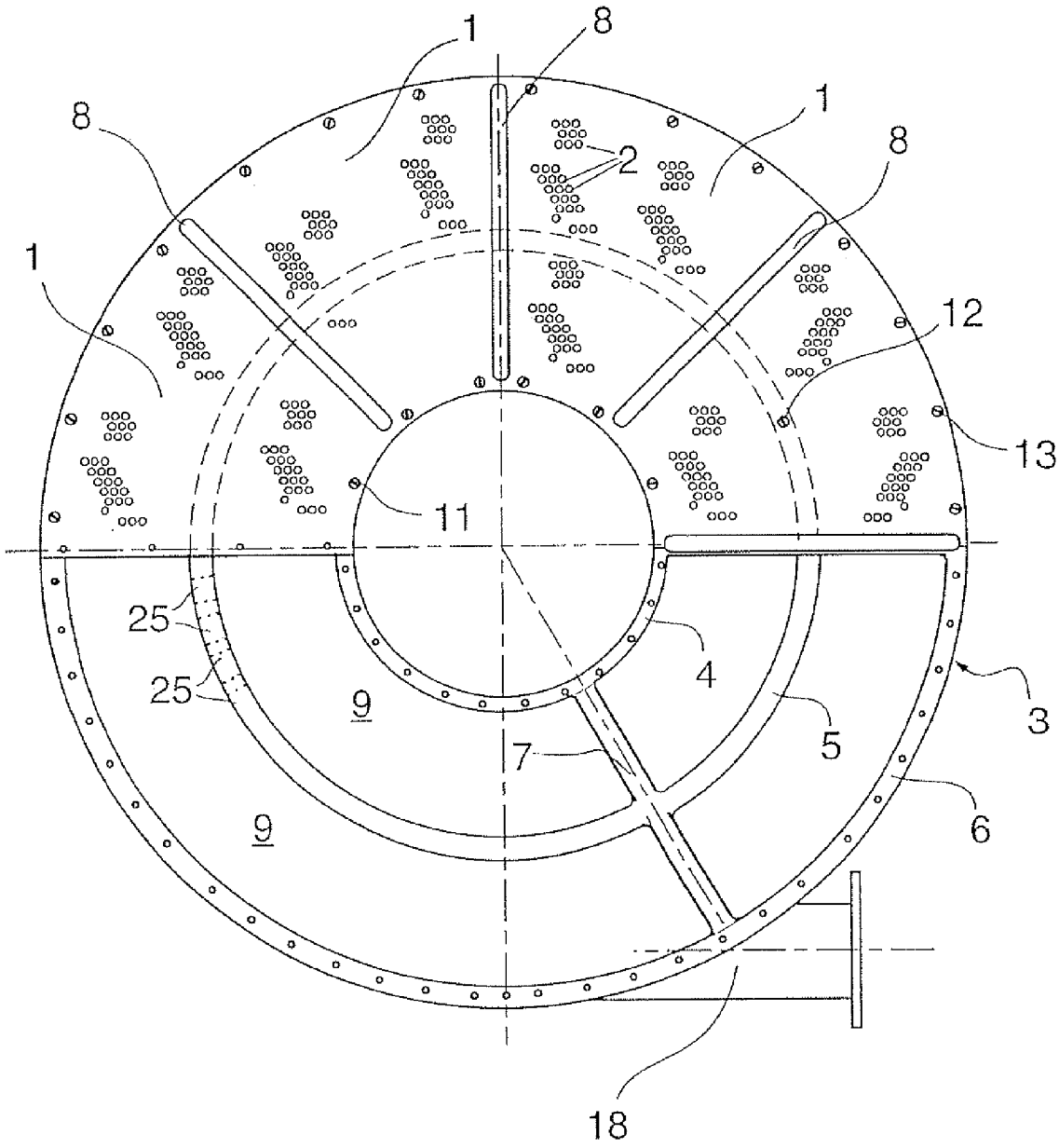
FIG. 1: Top view of the screen of a screening device according to the invention.

FIG. 1 shows the view of a screen plate 1 (half of which is drawn) and the way it is installed with respect to the support structure 3. The support structure 3 comprises an inner support ring 4, a middle support ring 5 and an outer support ring 6. These three and preferably concentric support rings serve to attach the screen plate 1 of the screening device according to the invention. It is possible to make the screen plate 1 in form of a complete ring or to assemble it from individual annular segments during the construction of the screening device. In a manner known per se, the screen plate 1 separates the inflow chamber 19 (FIG. 6) from the accepted-stock chamber 9 of the screening device. In the bottom part of FIG. 1, the accepted-stock chamber 9 is openly visible, as the screen plate 1 is not drawn there.

Figure 3:
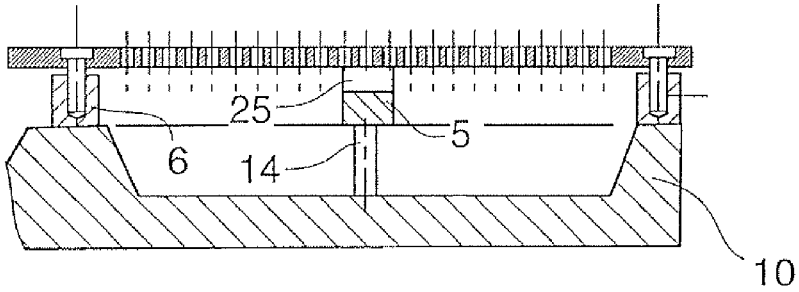
FIG. 3: A varied support ring.

In the exemplary embodiment of the invention, the support structure 3 has a single middle support ring 5. This support ring may have a closed surface towards the screen (FIG. 3), or can be provided with radially open recesses 25, e.g., with radial grooves (FIG. 1, drawn with dashed lines).

The three support rings are connected to one another by a radial brace 7. This brace serves to hold the three support rings together, which facilitates the mounting of the support structure 3. The radial brace 7 is advantageously arranged in the area of the outlet opening 18, where it least obstructs the flow in the accepted-stock chamber 9. In the mounted state the screen plate 1 is connected to the outer support ring 6 by screws 13 and to the inner support ring 4 by screws 11. Advantageously, the screen plate 1 and the middle support ring 5 may not be connected by screw joints, which greatly simplify the mounting. However, in special cases, i.e., with a particularly high dynamic load, a screw joint may be also utilized, as indicated, by way of example, in FIG. 1 by a screw 12.

As mentioned above, screen plates 1 in wet screening devices are often provided with strips 8 that can be arranged radially or at an angle to the radius and improve the effect of the screening device in particular when an additional disintegrating effect is desired in the screening device, which is the case, e.g., with pulpers and secondary pulpers.

Figure 2:
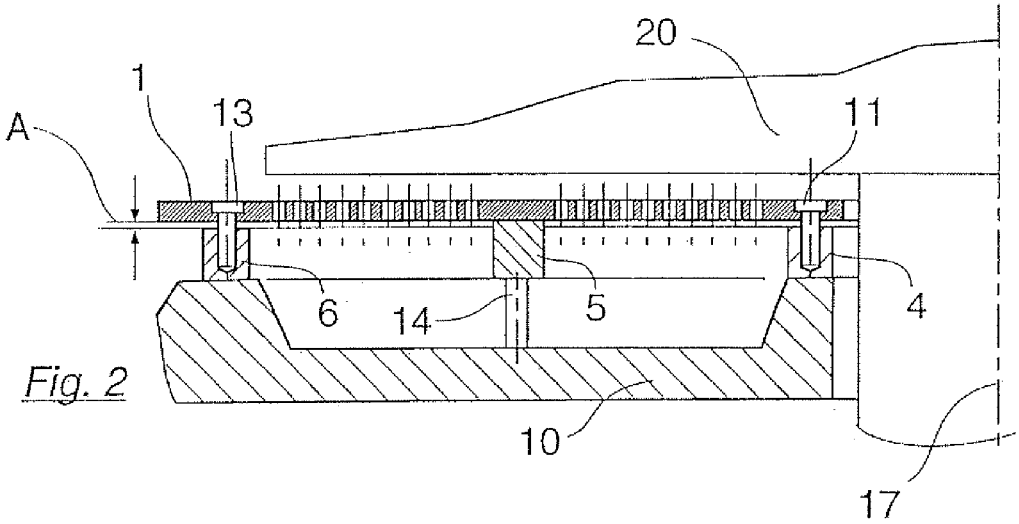
FIG. 2: Section through the screen area of a screening device according to the invention.

FIG. 2 demonstrates how the screen plate 1 is mounted in the screening device. Thereby, the middle support ring 5 protrudes over, i.e., axially above, the inner support ring 4 and the outer support ring 6 by a projecting length A in the direction of the screen plate 1. During the mounting of the screen plate 1—i.e., when the screws 11 and 13 are tightened—the screen plate 1 is elastically pre-stressed, thereby producing compressive forces directed against the middle support ring 5. The projecting length A preferably lies in the range between 0.5 and 1 mm (drawn disproportionately large in FIG. 2). The protruding part of the middle support ring 5 does not have any disadvantageous effect on the function of the screen plate 1, although a certain buckling of the screen plate 1 cannot be prevented.

In FIG. 2, a part of the rotor 20 is also indicated by a dashed line. The rotor 20 and the screen plate 1 have the same center line 17. The support rings 4 and 6 are directly attached to the housing 10 and thus seal off the accepted-stock chamber 9 radially inward and outward. The middle support ring 5 is supported in the housing 10 through a single ring or several spacers 14, e.g., welded studs, which are located in the accepted-stock chamber 9.

In special embodiments (see FIG. 3), the middle support ring 5 is provided with a number of projections radially towards the screen side. Between said projections are further radially open recesses 25, e.g., radial grooves. Thus, additional free screen area is made possible without any loss of strength at the attachment.

As noted above, instead of a complete middle ring, the spacers 14 could also extend up to the screen and thus serve as support elements (not drawn).

Figure 4:
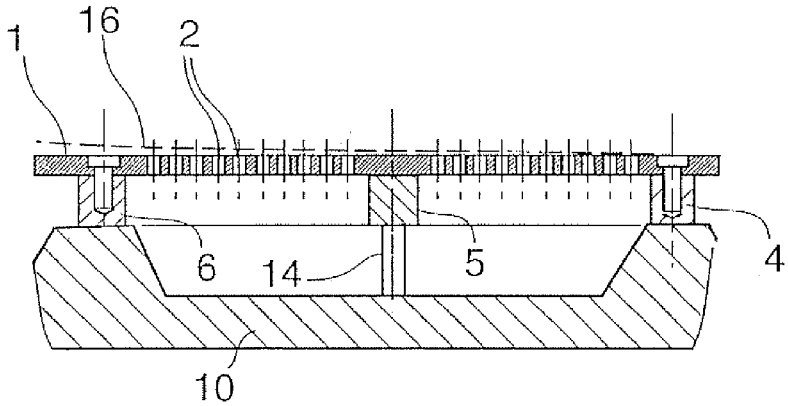
FIG. 4: A screen attachment variation.

It is also possible to create the elastic pre-stressing by using a screen plate 1 that is slightly curved in the non-mounted state, indicated in FIG. 4 by a curvature line 16. It is preferred that such curvature be applied through individual screen ring elements rather than a complete screen ring. Moreover, the middle support ring 5 can then end towards the screen plate 1 in the same plane as the inner support ring 4 and the outer support ring 6. Although this embodiment is somewhat more complex, it has the advantage that the screen plate 1 is exactly level towards the rotor.

Figure 5:
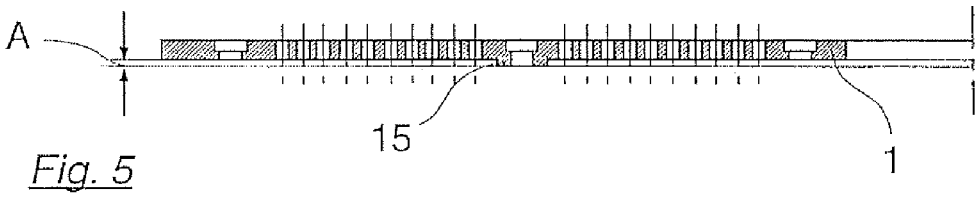
FIG. 5: A further screen plate suitable for the screening device according to the invention (shown in section)

FIG. 5 shows a further option of embodying the screen plate according to the invention. In this embodiment the screen plate 1" is provided with a projection 15 on the side facing the middle support ring 5, which projection protrudes by the dimension A' with respect to the remaining screen area and amounts to preferably 0.1 to 1 mm. Alternatively, the projection can have a projection length between 0.2 and 5 mm or between 0.5 and 1 mm. The projection 15 can be annular, corresponding to the middle support ring 5, or also be composed of annular arranged spacer pieces, e.g. knobs. Alternatively, an intermediate layer, in particular a spacer ring, can also be used instead of the projection 15.

Figure 6:
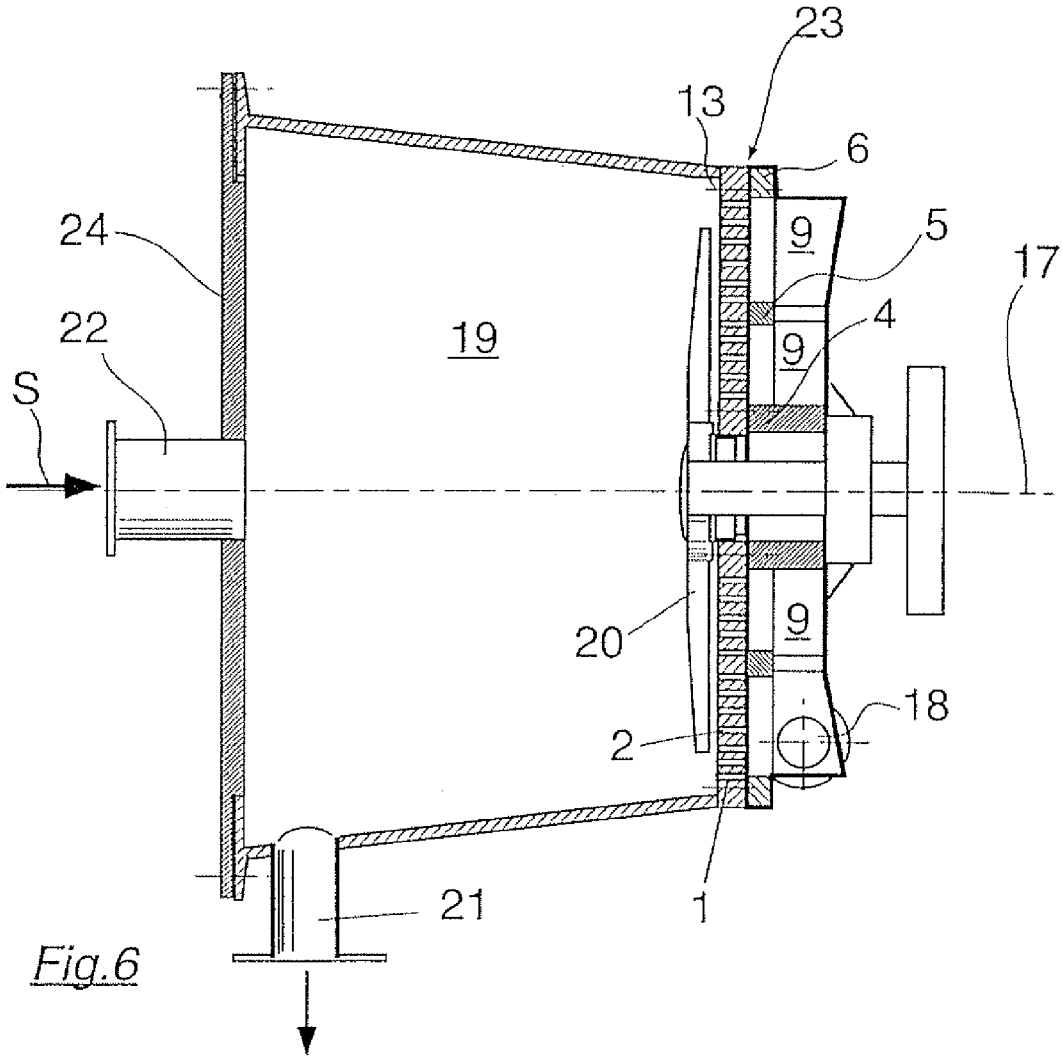
FIG. 6: A secondary pulper embodied according to the invention.

An example of the invention applied in a secondary pulper is shown in FIG. 6. A secondary pulper is a screening device, in which stress problems occur in a particularly severe manner. Secondary pulpers are customarily in the closed system of a paper stock preparation. Pumps are installed in the supply and discharge lines, and sliders are actuated during operation, causing the hydraulic thrusts described above. In addition, the rotor 20 causes vibrations in the area of the screen plate 1. The secondary pulper shown in FIG. 6 has a rotationally symmetric container 23 with an inflow chamber 19 for the paper fiber suspension S, wherein the chamber is provided with an inflow pipe 22 and a reject outflow 21. The container 23 is closed by a lid 24 at one front side, while the screen plate 1 is located on the opposite side, separating the inflow chamber 19 from the accepted-stock chamber 9. A rotor 20 serves to scrape the screen plate 1 in the manner described above, ensures the necessary movement in the inflow chamber 19, and further disintegration of the fibrous material flowing in. The screen plate 1 is attached to a support structure 3 with an inner support ring 4, a middle support ring 5 and an outer support ring 6.

The invention can also be applied in flat-screen pressurized sorters having a similar structure as secondary pulpers, however the disintegration effect of the rotor plays a much less important role or none at all.

Figure 7:
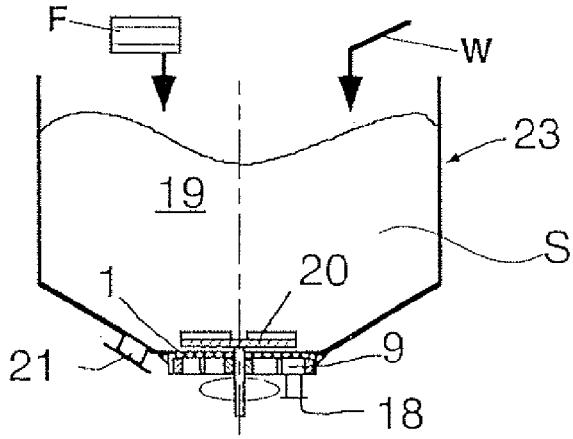
FIG. 7: A pulper embodied according to the invention.

Another application of the invention, shown in an exemplary manner in FIG. 7, is the screen area of a pulper with a rotationally symmetric container 23 that is open at the top. In this container, e.g., air-dry fibrous material F is mixed with water W and brought into suspension S. As is known, pulpers of this type also have a mostly level screen plate in the area of the material outlet, which screen plate is also subject to vibrations and hydraulic thrusts and can be advantageously attached according to this invention.

It is noted that the foregoing examples have been provided merely for the purpose of explanation and are in no way to be construed as limiting of the present invention. While the present invention has been described with reference to an exemplary embodiment, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS

1 Screen plate
2 Screen opening
3 Support structure
4 Inner support ring
5 Middle support ring
6 Outer support ring
7 Radial brace
8 Strip
9 Accepted-stock chamber
10 Housing
11 Screw
12 Screw
13 Screw
14 Spacer
15 Projection
16 Curvature line
17 Center line
18 Outlet opening
19 Inflow chamber
20 Rotor
21 Reject outflow
22 Inflow pipe
23 Container
24 Lid
25 Recesses
A Projecting length
A' Dimension
F Fibrous material
S Paper fiber suspension
W Water

The invention claimed is:

1. A screening device for the wet screening of a paper fiber suspension comprising:

at least one screen plate having a plurality of screen openings;

a support structure being detachably attachable to the screen plate and comprising an outer support ring and an inner support ring;

at least one middle support element arranged radially between the inner and outer support rings to support the at least one screen plate;

a rotor movable adjacent the screen plate; and an outlet opening for a portion of the paper fiber suspension passing the screen openings;

wherein the at least one screen plate is pre-stressed to exert compressive forces on at least one middle support element and tensile forces on both the inner and the outer support rings, wherein the rotor is located on a side of the screen plate opposite the outlet opening.

2. The screening device according to claim 1, wherein said compressive forces exceed the tensile forces produced by vibrations and thrusts occurring against the screen plate during wet screening.

3. The screening device according to claim 1, wherein the at least one middle support element comprises at least one middle ring and the screen plate is arranged to lie against at the least one middle support ring without attachment.

4. The screening device according to claim 1, wherein the at least one middle support element comprises at least one middle ring and the screen plate is screwed together with at least one middle support ring.

5. The screening device according to claim 1, wherein the at least one middle support element comprises a middle support ring having radially open recesses on a side facing the screen plate.

6. The screening device according to claim 1, wherein the screen plate is level and has a circular or annular shape.

7. The screening device according to claim 1, further comprising at least one radial brace to connect the support rings to one another.

8. The screening device according to claim 6, wherein the support rings are connected to one another by a single radial brace.

9. The screening device according to claim 1, wherein the at least one middle support element comprises a single middle support ring.

10. The screening device according to claim 1, further comprising a housing, wherein the support structure is detachably attachable to the housing of the screening device.

11. The screening device according to claim 1, wherein the support structure forms a part of a housing of the screening device.

12. The screening device according to claim 10, wherein the inner support ring and the outer support ring are directly connected to the housing of the screening device and the at least one middle support element is connected to the housing via spacers.

13. The screening device according to claim 1, wherein, at least in an non-mounted state, the at least one middle support element extends above an axial height of the inner and outer support rings by a projecting length in a direction of the screen plate.

14. The screening device according to claim 13, wherein the projecting length is between 0.2 and 5 mm.

15. The screening device according to claim 14, wherein the projecting length is between 0.5 to 1 mm.

16. The screening device according to claim 1, wherein, in at least a non-mounted state, the screen plate comprises at least one projection on a side facing the at least one middle support element that protrudes by a projecting length with respect to the remaining screen area.

17. The screening device according to claim 16, wherein the projection is formed by an intermediate layer with a thickness corresponding to a dimension.

18. The screening device according to claim 17, wherein the intermediate layer is a spacer ring.

19. The screening device according to claim 18, wherein the projecting length is between 0.2 and 5 mm.

20. The screening device according to claim 18, wherein the projecting length is between 0.5 to 1 mm.

21. The screening device according to claim 1, wherein the screen plate, in a non-mounted state, is slightly curved so as to exert a compressive force on the at least one middle support element after attachment to the inner and outer support rings.

22. The screening device according to claim 1, wherein the screen plate is provided with several strips projecting beyond the screen area of the screen plate on an inflow side.

23. The screening device according to claim 1, wherein the screening device is a secondary pulper.

24. The screening device according to claim 1, wherein the screening device is a pressurized sorter.

25. The screening device according to claim 1, wherein the screening device is part of a pulper.

* * * * *